US007560009B2

(12) United States Patent
Hägg et al.

(10) Patent No.: US 7,560,009 B2
(45) Date of Patent: Jul. 14, 2009

(54) METHOD AND APPARATUS AT A TWIN-WIRE PRESS AND ALSO A TWIN-WIRE PRESS

(75) Inventors: Torbjörn Hägg, Hudiksvall (SE); Leif Odmark, Matfors (SE)

(73) Assignee: Metso Paper, Inc. (FI)

( * ) Notice: Subject to any disclaimer, the term of this patent is extended or adjusted under 35 U.S.C. 154(b) by 307 days.

(21) Appl. No.: 10/589,642

(22) PCT Filed: Mar. 7, 2005

(86) PCT No.: PCT/SE2005/000330

§ 371 (c)(1),
(2), (4) Date: Sep. 8, 2006

(87) PCT Pub. No.: WO2005/084840

PCT Pub. Date: Sep. 15, 2005

(65) Prior Publication Data

US 2007/0193709 A1 Aug. 23, 2007

(30) Foreign Application Priority Data

Mar. 9, 2004 (SE) ..... 0400588

(51) Int. Cl.
*D21F 1/32* (2006.01)

(52) U.S. Cl. ..... 162/199; 162/212; 162/272; 162/305; 427/331; 428/413

(58) Field of Classification Search ..... 162/199, 162/212, 272, 305; 427/331; 428/413
See application file for complete search history.

(56) References Cited

U.S. PATENT DOCUMENTS

| | | | | | |
|---|---|---|---|---|---|
| 3,775,241 | A * | 11/1973 | Justus et al. | ..... | 162/199 |
| 5,371,975 | A * | 12/1994 | Lundmark | ..... | 451/9 |
| 5,853,318 | A | 12/1998 | Thom et al. | | |
| 6,379,227 | B1 * | 4/2002 | Hellman et al. | ..... | 451/49 |

FOREIGN PATENT DOCUMENTS

| | | | |
|---|---|---|---|
| EP | 0 676 501 | A2 | 10/1995 |
| FI | 90503 | B | 11/1993 |
| GB | 2 136 716 | A | 9/1984 |
| WO | WO-97/31755 | A1 | 9/1997 |

* cited by examiner

*Primary Examiner*—Mark Halpern
(74) *Attorney, Agent, or Firm*—Lerner, David, Littenberg, Krumholz & Mentlik, LLP

(57) ABSTRACT

The present invention relates to a method for machining of a surface (31) of a roll in a twin-wire press (2), comprising lower rolls (4, 6, 8, 25'), an endless lower wire (10), upper rolls (14, 16, 18, 25"), and an endless upper wire (12). The rolls comprise a coating (32). An apparatus (50) having a movable machining tool (54) for machining of the coating (32) is arranged in connection to a space between a wire (10, 12) and a roll (4, 6, 8, 14, 16, 18, 25', 25"). The machining tool (54) of the apparatus is moved, in contact against the surface of the roll (31) for cutting of the coating (32) to a desired level during rotation of the roll. The present invention also relates to an apparatus (50) for machining of a surface (31) of a roll in a twin-wire press for dewatering of a fiber suspension comprising said apparatus.

7 Claims, 6 Drawing Sheets

METHOD AND APPARATUS AT A TWIN-WIRE PRESS AND ALSO A TWIN-WIRE PRESS

Figure 1:
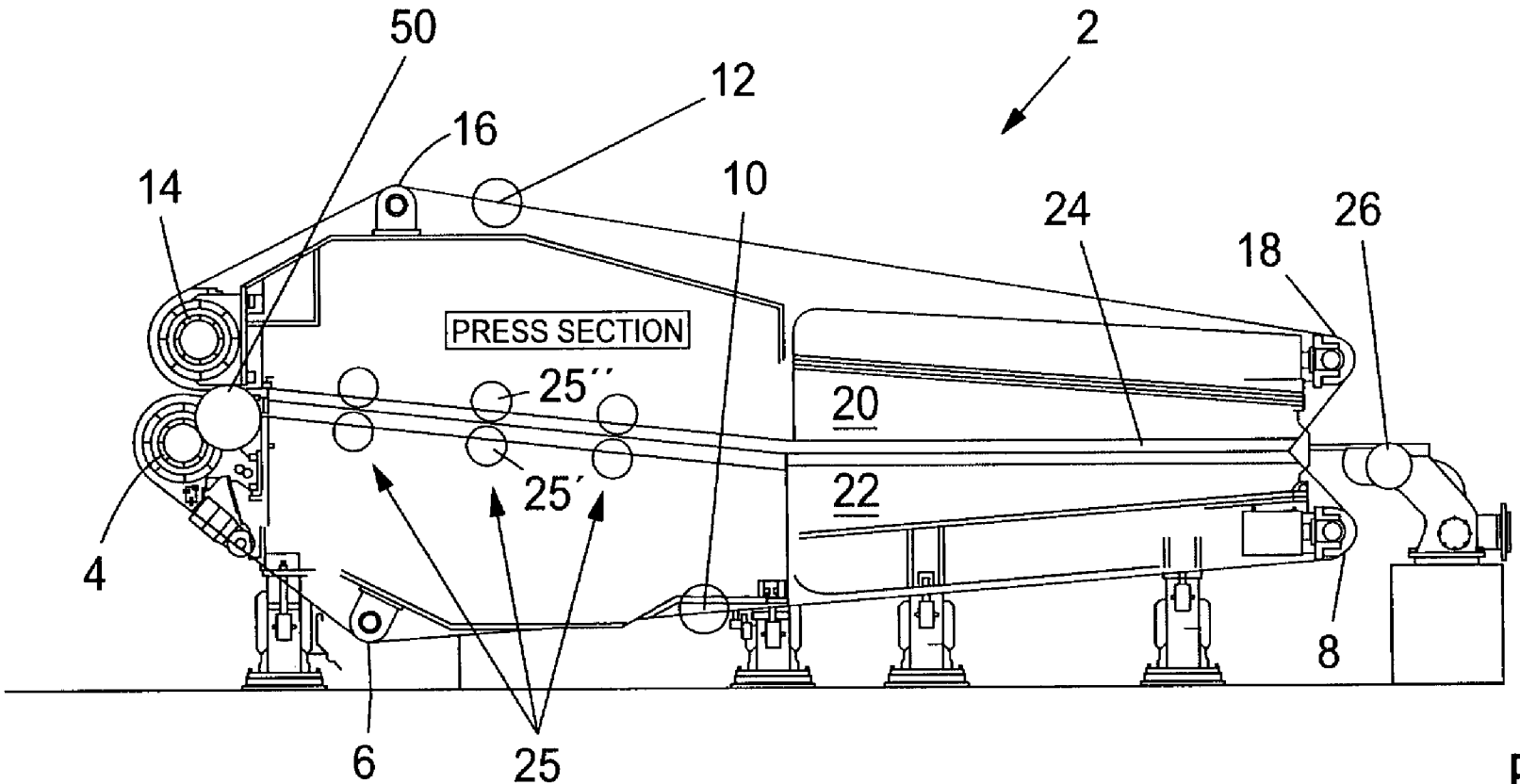

This application is a 371 of PCT/SE05/00330 filed 7 Mar. 2005.

The present invention relates to a method for machining of a surface of a roll in a twin-wire press and also a twin-wire press for dewatering of a fibre suspension comprising said apparatus.

Twin-wire presses for dewatering of a fibre suspension and forming of a continuous web thereof are previously known. Dewatering of the pulp is usually done from an inlet pulp concentration of 3-8 percentages by weight to an outlet pulp concentration of 30-50 percentages by weight. According to the state of the art, such twin-wire presses comprises lower rolls, an endless lower wire running in a path around the lower rolls, upper rolls, and an endless upper wire running in a path around the upper rolls. The two wires co-operate with each other along sections of said paths that run substantially in parallel with each other for dewatering of the fibre suspension between the wires during displacement thereof. An inlet box provides for supply of the fibre suspension to a wedge-shaped dewatering space between the wires. The twin-wire press further comprises two dewatering tables supporting the respective wire in said sections of the path and forming the wedge-shaped dewatering space between the wires for initially pressing and dewatering the fibre suspension, whereby a web is formed between the wires, and a roll arrangement situated after the dewatering tables in said sections of the paths, as seen in the direction of movement of the wires, for finally pressing and dewatering the web between the wires, so that the web will get a desired dryness.

Due to the high load involved by the pressing and the dewatering of the fibre suspension between the wires, a wear occurs on the rolls. The rolls, over which respective wire runs in the dewatering space, are provided with a polymer or a rubber coating that is worn out depending on the high loads that acts at the ends of the rolls. Wear of the coating on the rolls occurs along the whole of that part where the running wires on the rolls are in contact with the fibre web/suspension. The width of the wires is slightly shorter than the rolls which mean that the side edges of the wires are arranged somewhat within the short sides of the rolls. This leads to that the coating on the surface of the roll is not worn out at an area between the end of the fibre web/suspension out to the short sides of the rolls. At a certain degree of worn out coating on the rolls the unworn coating must be taken care of, since the coating that is not worn out on the opposite rolls, fore example an upper roll and a lower roll in a press nip, otherwise finally would come into contact with each other. Otherwise these minor areas of unworn coating will finally carry the whole load of the pair of rolls.

Originally applied coating is relatively thick, and consequently the coating can be cut down several times before the coating is totally worn out and a completely new coating has to be applied on the roll. Conventionally, cutting down of the coating is done by removing the roll, with the worn out coating, from the twin-wire press and the roll is placed in a specific roll grinding machine, whereafter the coating is cut down to the same or lower level as the coating of the remaining coating on the surface of the roll. A substitute roll can be installed, as replacement for the removed roll, if there is one available. Alternatively cutting of the coating can also be done with the roll remaining in the press, but with the wire removed. In both of the preceding methods for roll grinding the press have to be stopped, the wire must be completely taken of from the press during the machining and reinstalled in the press when the machining is finished, which is very time-consuming and requires simultaneous assembly/disassembly by several people. Removal of the wire often also involves that the wire has to be cut of or replaced due to that it very easily is damaged at the disassemble or that it is simply not possible to disassemble in one piece depending on difficulties to remove pulp from certain parts and in particular from the dewatering table.

FI-B-90503 discloses a method for restoration of a roll in a paper machine by grinding of the outer ends of the roll at a side area of the roll by a grinding apparatus, with the roll located in position at its operation place in the paper machine. The grinding is provided by rotating or non-rotating grindstone or abrasive belt. The apparatus can be moved in the longitudinal direction of the roll and also in its radial direction.

GB-A-2136716 discloses an apparatus for grinding/polishing of rolls that have been used for steel or the similar. There is no wire to take into consideration when designing the apparatus.

The object of the present invention is to achieve an easier, more effective and improved method and apparatus for taking care of wearing of rolls and at least to eliminate those drawbacks that are associated with previously known state of the art. Yet an object is to provide a cost efficient and work saving method and apparatus.

These objects are achieved with the method for machining of a surface of a roll in a twin-wire press according to the present invention. The twin-wire press comprises lower rolls, an endless lower wire that runs in a path around the lower rolls, upper rolls, and an endless upper wire that runs in a path around the upper rolls, and the roll surface of said rolls comprises a coating. The method is characterised in that an apparatus having a movable machining tool for machining of the coating, which apparatus comprises means for removal of cut down material from the coating, is arranged in connection to a space between one of said wire and a roll, respectively. Further, the machining tool of the apparatus is moved, from a rest position in connection to said space at the twin-wire press, in contact against the surface of the roll for cutting of the coating to a desired level during rotation of the roll during removal of cut down material at machining. The machining tool is brought back to the original rest position when the cutting down of the coating to desired level has been achieved.

The present invention makes it possible that the operation of the press need not be interrupted or only need to be interrupted for a short period during the machining of the coating. Besides that time saving is achieved, the equipment requires operation only by one person. Further, the wire needs not to be taken away during the machining and does not run the risk of being damaged at the machining. To remove cut down material from the machining is of vital importance if grinding should be carried out during operation and also when the twin-wire press is not in operation and when grinding is carried out with the wires in the position on the rolls, since material from the coating not is allowed to end up in the twin-wire press and in contact with the pulp. Therefore, it is important that cut down material is efficiently transported away during the grinding.

The machining of the coating is carried out at an end area of a roll. The machining can be done continuously during operation. Cutting is preferably obtained by moving the machining tool axially along the roll. A machining tool operated by compressed air can suitably carry out machining and the machining is suitably performed by milling. Machining is suitably carried out of the coating of drive rolls and is preferably carried out on rolls involved in a press nip.

The present invention also relates to an apparatus for machining of a surface of a roll in a twin-wire press. The apparatus comprises a support intended, at least during the machining, to be stationary arranged in connection to a space between a roll and a wire at said twin-wire press. The apparatus further comprises a movable machining tool arranged to the support for machining of a coating of said surface of the roll. The apparatus further comprises means for removal of cut down material from the coating during the machining.

The machining tool is suitably arranged on a slidably and displaceable arm journalled in bearings. The machining tool can be pivotally arranged in a first end of the arm. The displaceable arm can be arranged slidably matched and displaced in a sleeve that is arranged to the support. Said sleeve is suitably displaceable arranged to the support for adjustment of the level of height above the surface of the roll. The apparatus may further comprise a screw bar arranged at the support and a connection member, arranged between the screw bar and the arm, which is fixed to an end of the arm. The connection member is suitably movably displaceable along the screw bar during rotation of this, such that the arm is moved in said sleeve. The machining tool can be a milling cutter operated by compressed air, suitably a shank end mill. The apparatus comprises means, such as suitably a piping arranged to the machining tool and connected to a vacuum cleaner or the similar, for removal of cut down material from the coating during machining.

The present invention also relates to a twin-wire press for dewatering of a fibre suspension, comprising lower rolls, an endless lower wire that runs in a path around the lower rolls, upper rolls, and an endless upper wire that runs in a path around the upper rolls, and said rolls comprise a coating. The twin-wire press is characterised in that it comprises an apparatus according to the present invention as disclosed herein.

Figures 2A, 2B:
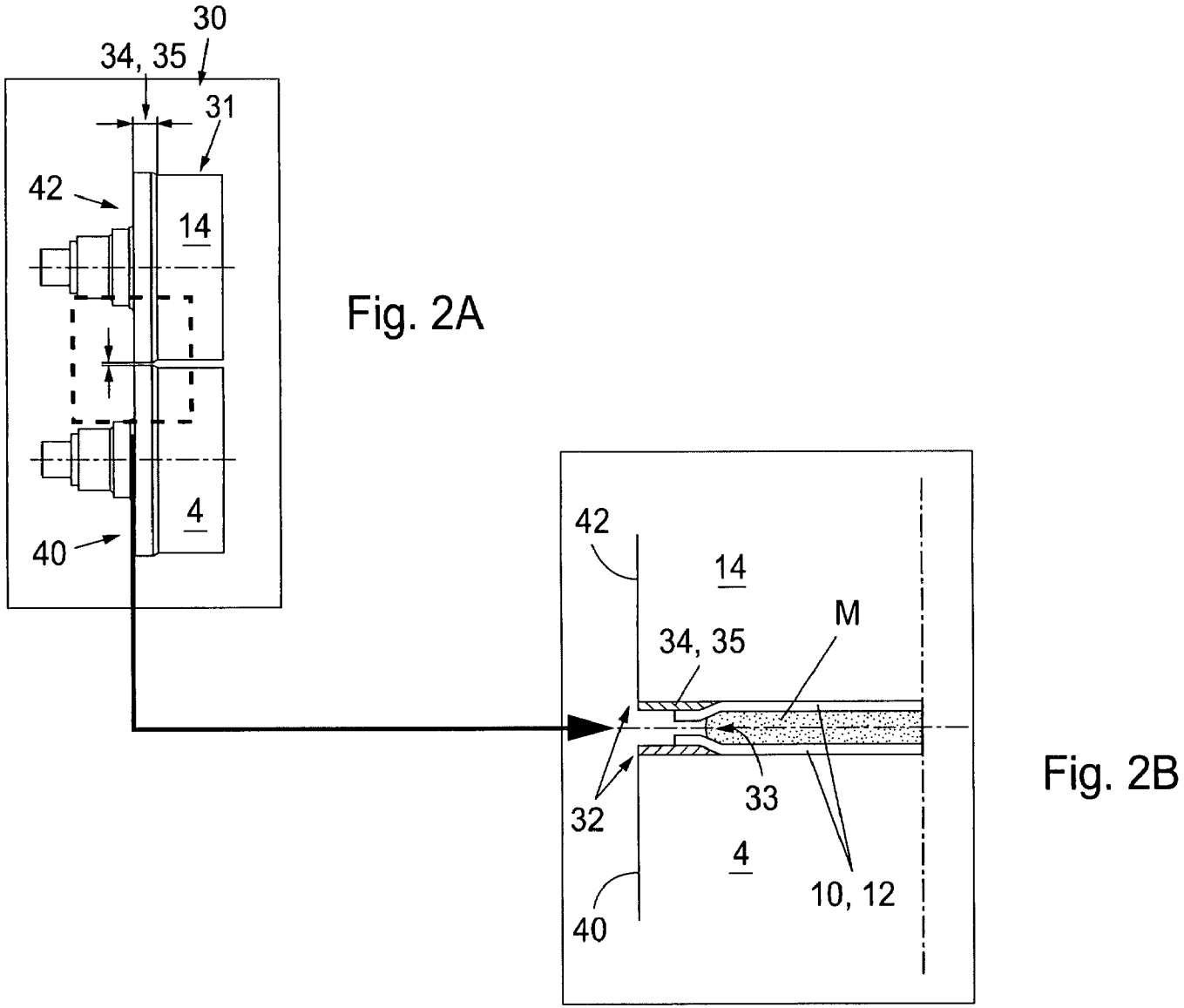
Figure 2C:
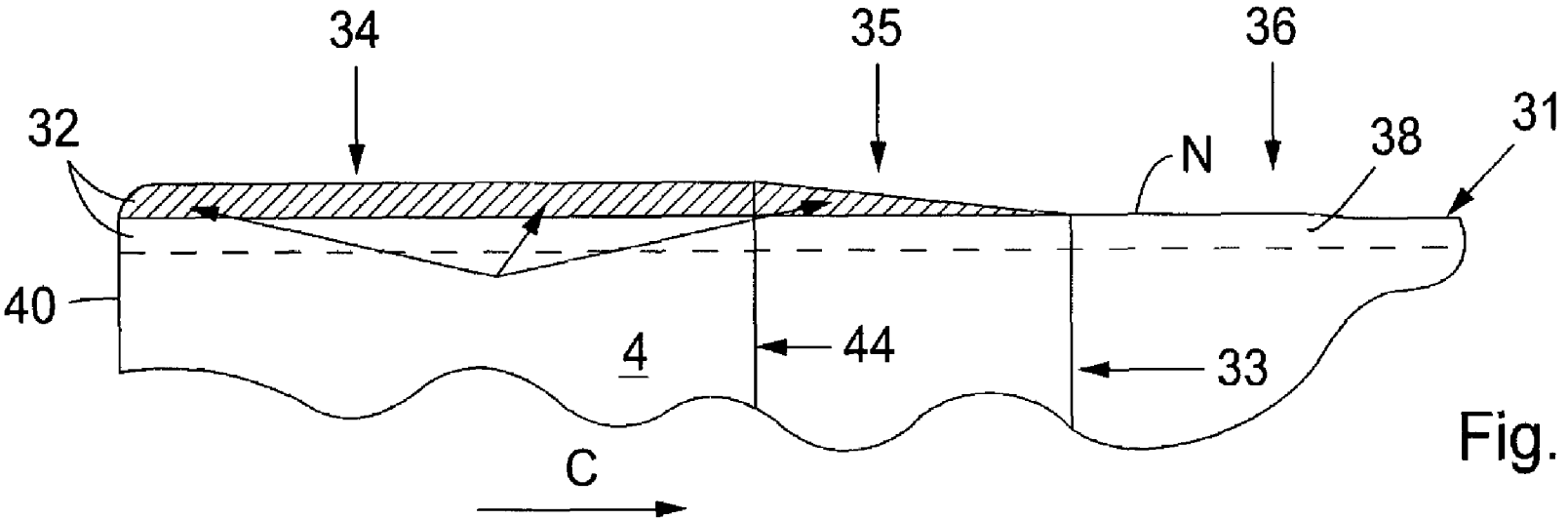
Figure 2D:
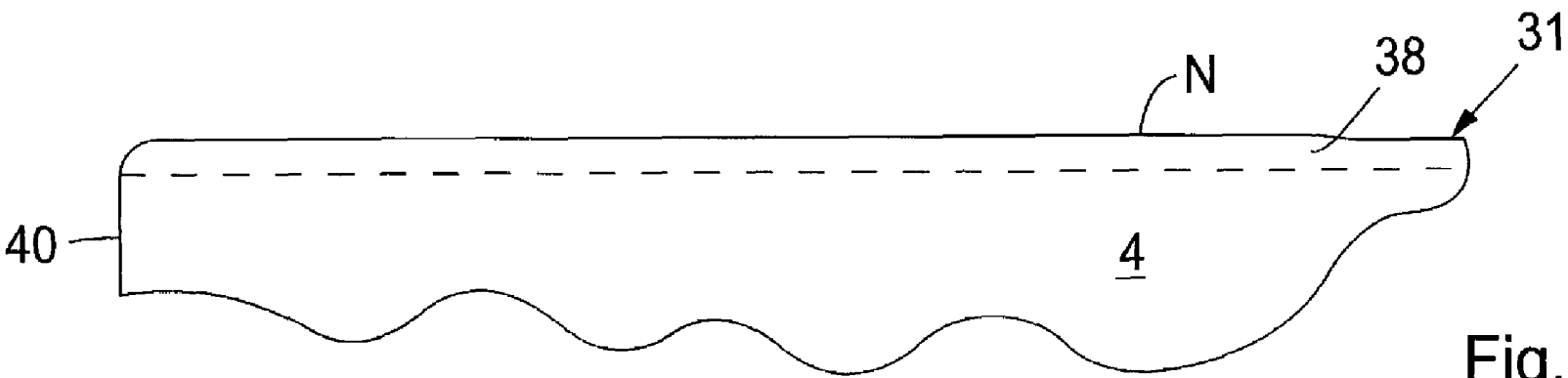
Figure 3A:
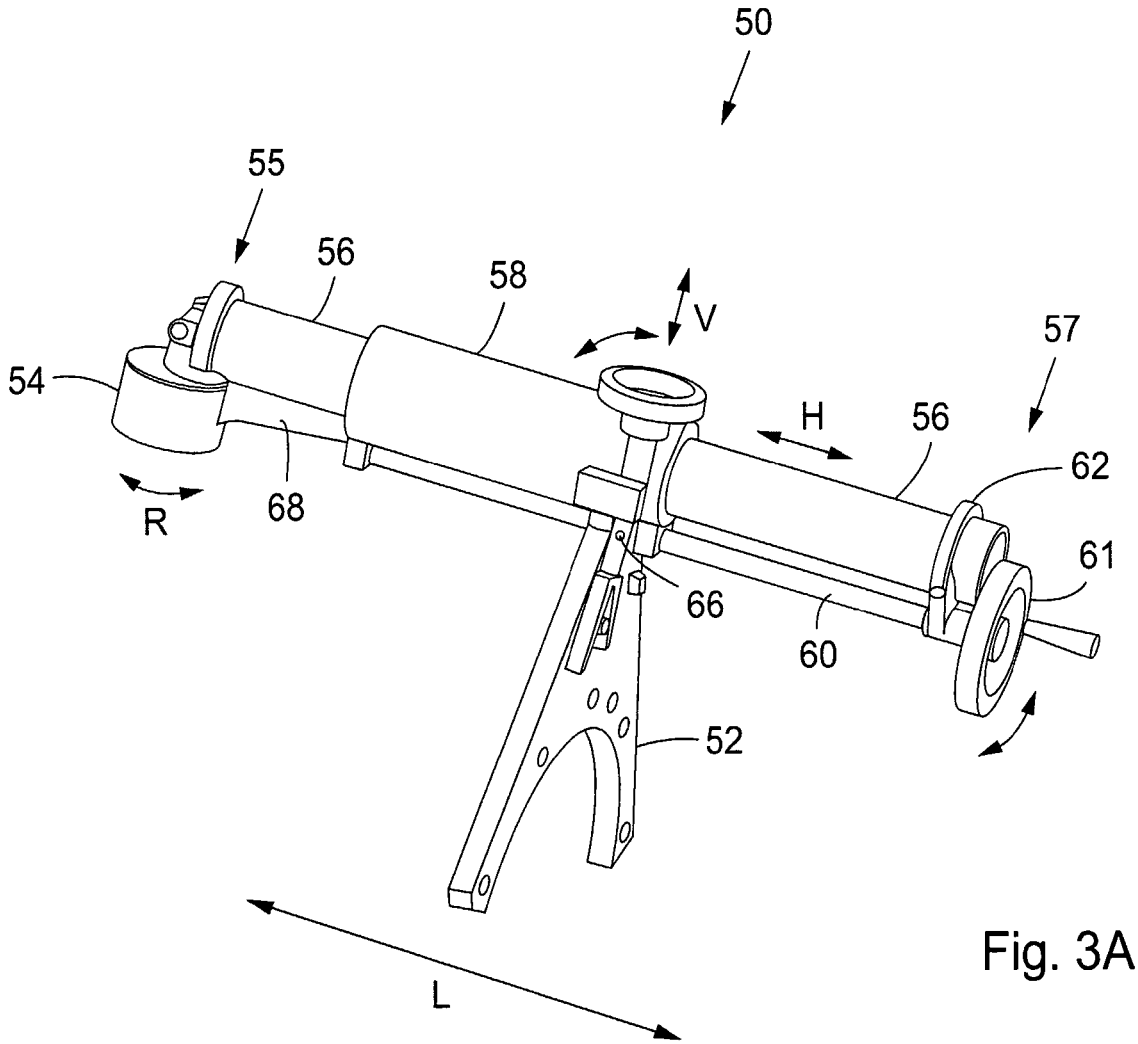
Figure 3B:
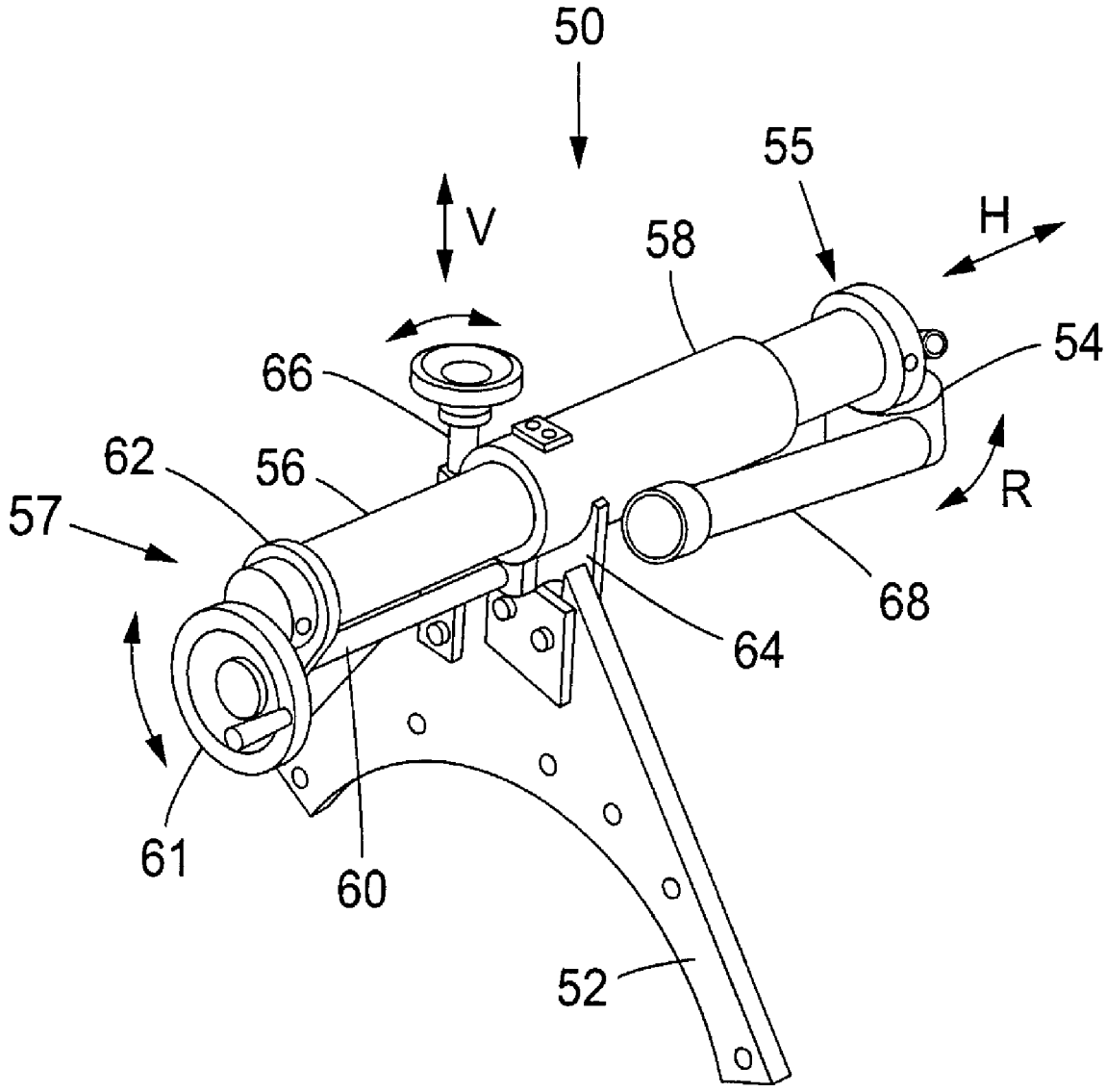
Figure 4:
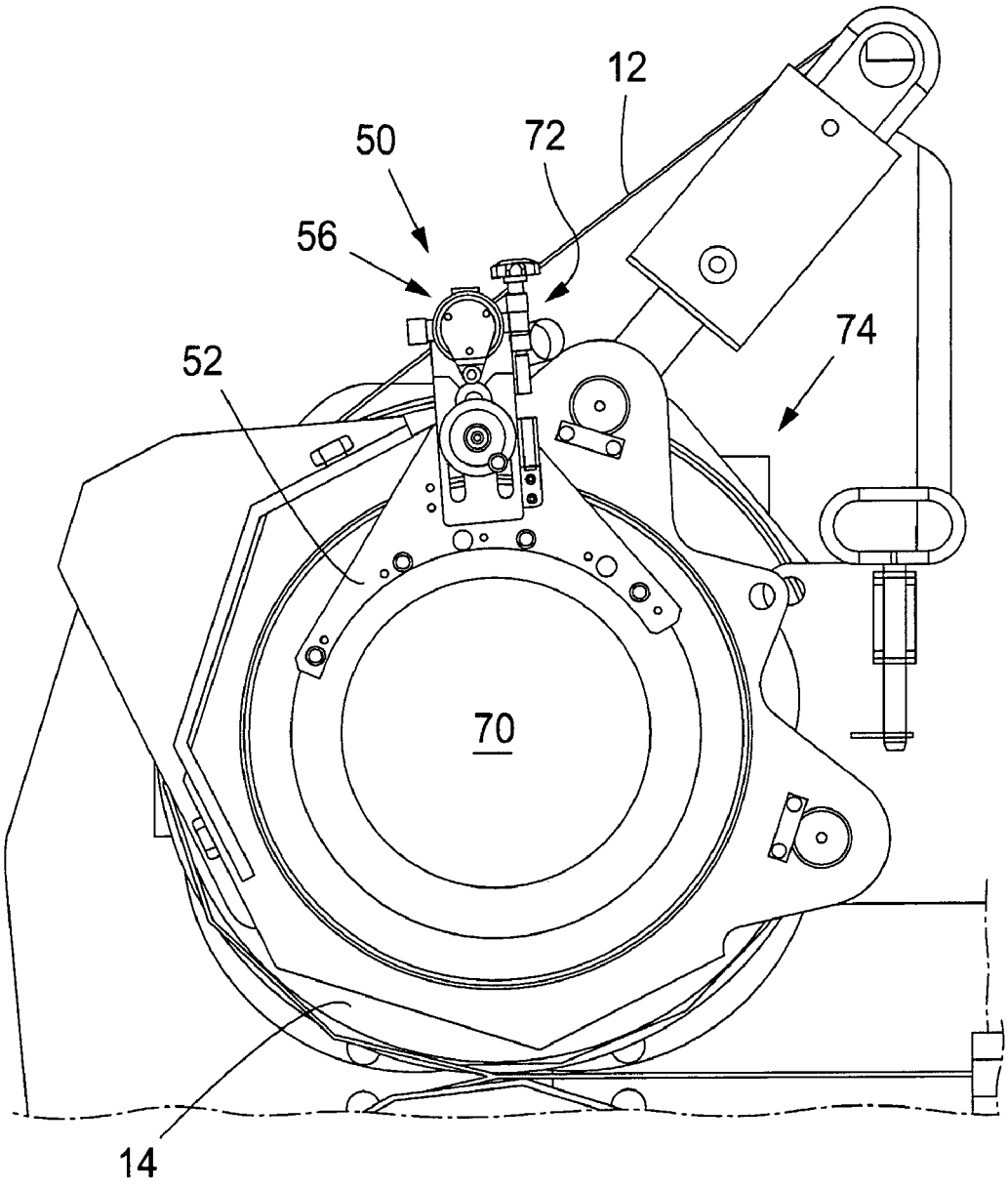

The present invention will now be described in more detail by embodiments, with reference to accompanying drawings, without restricted interpretation of the invention thereof, where FIG. 1 schematically shows in an overview a longitudinal cross-section through a twin-wire press according to an embodiment of the present invention, FIG. 2A shows in a schematic drawing an end area of a pair of rolls in a roll nip in a twin-wire press, having worn down coatings on the rolls, respectively, FIG. 2B shows an enlarged view of details in the roll nip in FIG. 2A, FIG. 2C shows in yet an enlarged detailed view a partial portion of the end area of a roll in FIGS. 2A and 2B, FIG. 2D shows the roll according to FIG. 2C after cutting of partial and completely unworn coating, FIG. 3A shows an apparatus according to an embodiment of the present invention for machining of a surface of a roll in a twin-wire press, FIG. 3B shows another view of the apparatus according to FIG. 3A, and FIG. 4 shows a position of the apparatus in FIGS. 3A-B in a twin-wire press according to an embodiment of the present invention.

Corresponding and similar details shown in the different embodiments in the drawings are represented by the same reference numerals.

FIG. 1 shows a twin-wire press 2 according to the present invention. The twin-wire press 2 comprises three lower rolls, viz. a drive roll 4, a control roll 6 and a tensioning roll 8. An endless lower wire 10 runs in a path around the lower rolls 4, 6 and 8. In a corresponding manner an upper endless wire 12 runs in a path around three upper rolls, viz. a drive roll 14, a control roll 16 and a tensioning roll 18. An upper dewatering table 20, that supports the upper wire 12, and a lower dewatering table 22, that supports the lower wire 10, forms the dewatering space 24 between the wires 10, 12 in which the fibre suspension/web M is dewatered. "Press section" refers to an ordinary roll arrangement according to the state of the art that can involve a plurality of roll pairs 25, such as schematically shown in FIG. 1. An inlet box 26 is arranged at one end of the press. An apparatus 50 for machining of a surface of a roll in the twin-wire press 2 is arranged, according to an embodiment of the present invention, in connection to a bearing housing of the drive roll 4. The apparatus 50 can also be arranged at other rolls, such as at any of the rolls 25', 25" in the pair of rolls 25 of the press section.

FIGS. 2A-B shows an end area 30 of an upper and a lower drive roll 4, 14 in a roll nip in a twin-wire press 2. The rolls have a roll surface 31 with a coating 32, originally in a smooth distributed layer around the circumference of the roll, of a polymer or a rubber material, such as is evident in an enlarged detailed view in FIG. 2C that shows the end area 30 of one of the rolls 4. In the end area of the rolls where the edge of the fibre web 33 ends between the wires and in the direction out against the short sides of the rolls, is during operation of the press formed an elevated portion 34, 35 of coating from the roll that is partly or completely unworn and that is higher than a worn out portion 36 of the coating in axial direction against the centre C of the roll. This completely and partly unworn portion 34, 35 of the coating 32 has to be cut, down to the same level as N or lower as the remaining coating 38 on the remaining part of the roll 4, when a distance A between the rolls 4, 14 at the short sides 40, 42 of the rolls, approaches zero during operation of the press 2. If the end area 30 at the roll is not cut down, this limited part of the roll will take more load than the coating will manage and the coating will finally fall into pieces. In FIG. 2C is shown a portion 34 with unworn coating in connection to the short end 40 of the roll that essentially extends from a position 44, where the side edge of the wire is arranged on the roll 4, forward to the short end 40. In immediate connection to the unworn portion 34 is formed a portion 35 with partly worn out coating that extends essentially from the position 44 of the edge of the wire forward to the position 33 where the edge 33 of the fibre web M is situated on the wire 10. From the latter position of the edge 33 of the fibre web, in axial direction towards against the centre of the roll, along the whole roll 4 where the fibre web is present on the wire 10, is during dewatering and pressing formed a portion with worn coating 36. FIG. 2D shows the roll in FIG. 2C after cutting of the coating at the partly worn 35 and unworn portion 34, respectively, that has been described above with reference to FIG. 2C.

FIGS. 3A and 3B shows an apparatus 50, according to an embodiment of the present invention, for machining of a surface of a roll in a twin-wire press 2 (see FIG. 1). The apparatus comprises a support 52 intended, at least during the machining, to be arranged stationary in connection to a space between a roll 4, 14 and a wire 10, 12 at said twin-wire press 2 (see FIG. 1). The support 52 can suitably be arranged to a bearing housing of a roll 4 at the short end 40, 42 (see FIGS. 2A-B) of the roll (see the location of the apparatus 50 in FIG. 1 and in FIG. 4 described below). Further, the apparatus comprises a movable machining tool 54 arranged to the support 52 for machining of a coating 32 (see FIG. 2B-C) of said surface of the roll 31. The machining tool 54 is arranged in a first outer end 55 of a slidably and displaceable arm 56 journalled in bearings. The displaceable arm 56 is arranged slidably matched and displaceable in a sleeve 58 that is arranged to the support 52, whereby the arm 56 can be displaced in a horizontal direction (see arrow H). The apparatus comprises a screw bar 60 arranged at the support 52, a connection member 62, arranged between the screw bar 60 and the arm 56, which is fixed to another end 57 of the arm, and which connection member 62 is movably displaceable along the screw bar 60 during rotation of the screw bar, by means of a guide wheel 61 arranged to the end of the screw bar, such that the arm 56 is moved in said sleeve 58. The machining tool is pivotally arranged (see arrow R) in the first outer end 55 of the arm. Further, said sleeve 58 is displaceable arranged to the support for adjustment of the level of height of the machining tool 54 above the surface 31 of the roll. In that respect the sleeve 58 is arranged to a holding member 64 that is displaceably arranged to the support 52. By way of a through oblong opening in the support, the holding member 64 is in threaded connection to a control bar 66, which when it is turned results in that the holding member 64 and thereby the machining tool 54 on the arm, that is arranged in the sleeve 58, can be displaced in a vertical direction (see arrow V). Suitably the machining tool 54 can be a milling cutter operated by compressed air, such as a shank end mill. The apparatus 50 comprises means, such as a tubular conduit 68 from the machining tool, to which conduit a vacuum cleaner (not shown) can be connected for example, for removal of cut material from the coating 32 during machining of the surface 31 of the roll.

FIG. 4 shows a preferred location of the apparatus 50 for machining of the surface of the roll of the upper drive roll 14 in the twin-wire press 2 according to the present invention. The support 52 for the apparatus 50 is arranged to the bearing housing 70 of the drive roll 14. The apparatus 50 is here positioned in immediate connection to the space 72 between the upper wire 12 and the drive roll 14. Thanks to the long and narrow shaping L (see FIG. 3A-B) of the apparatus 50 with the displaceable arm 56, in the horizontal direction H (perpendicular to the plane of the paper), to which the machining tool 54 (see FIG. 3A-B) is arranged at an outer end, machining can be performed in relatively limited spaces. Hence, the apparatus can suitably be placed in immediate connection to the limited space that is defined between roll and wire, at the inlet of the wire positioned before the wire meets the roll or alternatively at the outlet of the wire after the wire has released the roll, seen in the direction of running of the wire. Other locations of the apparatus 50 are also possible, for example at a space 74 on the backside of the roll.

When grinding, continuously or intermittently, during operation of the twin-wire press 2, the apparatus 50 will completely or partly be stationary at the press 2 and the shaping of the apparatus will then probably need to be adapted somewhat, however within the framework of the scope of protection according to the independent claims, in order to stand the surrounding environment.

The invention claimed is:

1. A method for machining the surface of a roll in a twin-wire press comprising a plurality of lower rolls, a plurality of upper rolls, an endless lower wire running in a path around said plurality of lower rolls, and an endless upper wire running in a path around said plurality of upper rolls, said plurality of upper and lower rolls including a roll surface comprising a coating thereon, said method comprising arranging a moveable milling tool for milling said coating at a location comprising a rest position relative to a space between one of said upper and lower wires and one of said plurality of upper and lower rolls, moving said milling tool from said rest position into contact with the surface of said one of said plurality of upper and lower rolls in order to cut said coating to a predetermined level during rotation of said one of said plurality of upper and lower rolls, and returning said milling tool to said rest position after said coating has been cut to said predetermined level.

2. The method of claim 1 wherein said moving of said milling tool comprises contacting an end of said one of said upper and lower rolls.

3. The method of claim 1 wherein said milling of said coating is carried out continuously during operation of said twin-wire press.

4. The method of claim 1 wherein said cutting of said coating comprises moving said milling tool axially along said one of said upper and lower rolls.

5. The method of claim 1, including operating said milling tool by compressed air.

6. The method of claim 1 wherein said one of said upper and lower rolls comprises a drive roll.

7. The method of claim 1 wherein said one of said upper and lower rolls comprises a roll involved in a press nip.

* * * * *